United States Patent [19]

Ikenaga et al.

[11] 4,207,061

[45] Jun. 10, 1980

[54] TOP-SHAPED LIME KILN

[76] Inventors: Toshio Ikenaga, 1-4-5, Miyoshi-cho, Kitami-shi, Hokkaido; Tatsu Chisaki, 2-30-9, Shimouma, Setagaya-ku, Tokyo, both of Japan

[21] Appl. No.: 952,945

[22] Filed: Oct. 20, 1978

[30] Foreign Application Priority Data

Oct. 21, 1977 [JP] Japan ..... 52-126485

[51] Int. Cl.[2] ..... F27D 1/08

[52] U.S. Cl. ..... 432/98; 432/102; 432/138; 432/139

[58] Field of Search ..... 432/96, 98, 102, 138, 432/139, 152, 176, 199

[56] References Cited

U.S. PATENT DOCUMENTS

| | | | |
|---|---|---|---|
| 1,999,761 | 4/1935 | Howard | 432/176 |
| 3,050,298 | 8/1962 | Hall | 432/177 |
| 3,331,595 | 7/1967 | Nelson et al. | 432/98 |

OTHER PUBLICATIONS

Page 64 of Publication II, Handbook of Gypsum and Lime, published on Jun. 15, 1972.

*Primary Examiner*—John J. Camby

*Attorney, Agent, or Firm*—Frishauf, Holtz, Goodman & Woodward

[57] ABSTRACT

In a top-shaped lime kiln which comprises a slowly rotatable platter-shaped kiln bed having a cylindrical calcined lime-cooling chamber extending downward for connection to the central opening of said kiln bed; an immovably hung round lid having a fuel combustion chamber extending upward for connection to the central opening of said lid; and raw limestone granules-feeding chutes 19 opened to an annular gap 12 formed between the peripheral walls of both bed and lid; an improvement wherein a hot-gas-circulating apparatus is fixed in the maturation zone of the cooling chamber, and automatically reciprocative pushing rods are inserted into the limestone granule layer formed on the rotary kiln bed through the peripheral wall of said bed or lid so as to let fall the calcined lime into the cooling chamber.

9 Claims, 5 Drawing Figures

TOP-SHAPED LIME KILN

BACKGROUND OF THE INVENTION

This invention relates to a lime kiln whose body has a unique top-shape.

Lime kilns known to date may be broadly classified into three types: a bottle-type, vertical shaft-type and rotary-kiln type.

Recently proposed is a doughnut-shaped lime kiln with a rotary bed originating with Calcimatic Limited Company of Canada. ("Japanese Handbook of Gypsum and Lime" published on June 15, 1972, pp 506–508 and pp 64–68 of its advertisement column). This proposed lime kiln is characterized by a closed doughnut-shaped rotary bed provided with a movable grate. While making one circulaton of the bed, lumps and granules of limestone carried on the grate pass through a prescribed hot space created by combustion of fuel blown into the kiln through numerous holes drilled in a certain section of a stationary lid; and when the kiln bed makes one rotation, a product of calcined lime is continuously scraped off the terminal point of the rotary bed. One rotation of the kiln bed takes about 50 to 70 minutes.

The above-mentioned Calcimatic Kiln produces as much as 100 to 600 tons of quick lime per day and the raw limestone granules are uniformly calcined regardless of size, though said kiln does not have a merit in thermal efficiency. However, said proposed Calcimatic Kilm still has the drawback that, with accessory equipment included, the kiln requires a tremendously huge apparatus and an extremely large plant area.

One of the present inventors previously disclosed an invention of a unique compact lime kiln of 30 to 50 ton-capacity per day which was designed to be annexed to an existing large lime kiln and efficiently calcine fine granules of limestone unadapted to be handled by such existing large lime kiln. (Japanese Patent Application published before examination with the Number of 104596/78, published on Sept. 11, 1978). This proposed compact lime kiln is of the type similar to the aforementioned Calcimatic Kiln in that a horizontal kiln bed is rotated. However, said lime kiln has a top-shape as against the doughnut-shape of the Calcimatic Kiln, and has a simple construction and is easily operated with successfully elevated thermal efficiency.

There will now be described by reference to FIG. 1 the construction of a top-shaped lime kiln embodying the prior invention.

Opened to the underside of the central portion of a platter-shaped bed 4 is a calcined lime-cooling chamber 7 provided at the bottom with a port concurrently used to suck in cooling air which acts as secondary air for complete combustion of fuel, and to allow the discharge of the calcined product. The bed 4 is rotatably supported by means of wheels 3 on a circular rail 2 laid on a trestle 1*a*. An upper lid section comprises a stationary coaxial round lid 10 covering the upper opening of the platter-shaped bed 4. The lid 10 has a fuel combustion chamber 15 including a downwardly extending burner 14 positioned at the central upper port. The lid 10 has an annular gap 12 defined between the peripheral wall thereof and that of the platter-shaped bed 4. The upper lid section is supported on a trestle 1 fixed on the ground. The annular gap 12 is closed by a gas sealer 13 generally used with a rotary kiln bed, thereby preventing gas generated in the kiln from leaking to the outside. Raw limestone granules 20 run down from a raw material tank 18 set on a trestle 1*c* through a proper number of chutes 19 into the air-tight annular gap 12. This gap is used to preheat the charged raw material by the passage of kiln exhaust. Calcined lime is scraped off by scrapers 17, each provided with a spring fixed to the lid 10, from the platter-shaped kiln bed 4 into a cooling chamber 7. After being cooled, the calcined lime is continuously taken out of the kiln by a rotary table extruder 8.

The above-mentioned lime kiln of the preceding invention has the following advantages.

(1) The slowly rotatable kiln body has a top-shape, thereby enabling a raw material-preheating region, calcining region and calcined lime-cooling chamber to be set collectively in a compact arrangement, and has a smaller kiln size than any of the prior art kiln bodies, as measured on the basis of the same production capacity. Further, heating in the kiln is effected by a proper combination of radiation and convection, realizing extremely high thermal efficiency. Maintenance and repair of the kiln interior can be easily carried out with the lid lifted by turnbuckles 11 of suspension hooks. Furthermore, a single burner provided at the center of the kiln body allows for easy operation. Since the cooling chamber 7 lies immediately below the burning zone, flames ejected from the burner are uniformly spread through the kiln and completely burned by the preheated secondary air rising from the cooling chamber 7.

(2) The annular gap 12 acts as a zone for preheating the charged raw limestone. This preheating zone has a large volume and a small height. The kiln exhaust slowly rises through said preheating zone with little passing resistance, reducing the power consumption of a blower 23. The rotation of the kiln bed suppresses the possibility of charged raw material hanging in the preheating zone, effectively realizing the uniform preheating of said charged raw material.

(3) Raw limestone granules which are thinly spread on the rotary kiln bed are preferred to have a sufficiently small size for calcination. Where, however, said granules have too small a size, then narrow gaps in between present a high resistance to the passage of kiln exhaust through the preheating zone. Therfore, the raw limestone granules are desired to have a size ranging between 4 and 40 mm. Such small limestone granules have hitherto failed to be used with the existing vertical type lime kiln. When annexed to an existing lime kiln, the above-mentioned top-shaped lime kiln enables crushed limestone granules having a broader range of size than obtained in the past to be easily utilized.

(4) Raw limestone granules thinly spread on the kiln bed need not have a considerably high mechanical strength. Therefore, the lime kiln embodying said preceeding invention allows the use of not only limestone granules but also pellets about 10 mm in diameter which are prepared from fine powders of calcium carbonate or lime cake, a waste material from the industrial manufacture of, for example, beet sugar.

Nevertheless, the top-shaped lime kiln embodying the preceding invention has later been found to be still defective. The facts are that the scrapers 17 provided with a spring do not function effectively; those portions of the scrapers 17 which are directly exposed to the kiln flames often tend to be damaged; and the partially imperfect calcination of raw limestone, as is observed in conventional lime kilns, unavoidably takes place in said top-shaped lime kiln, too.

SUMMARY OF THE INVENTION

This invention has been accomplished in view of the above-mentioned drawbacks accompanying the preceding invention, and is intended to provide an improved top-shaped lime kiln which is free from said drawbacks.

The improvement has been accomplished by the following arrangement.

(1) Application of scrapers provided with a spring has been abandoned. Instead, a plurality of pushers are mounted on the corresponding trestles for forceful reciprocation of pushing rods. A proper number of holes are bored in the peripheral wall of the kiln bed or lid to allow the pushing rods to penetrate the kiln body toward the center of the kiln bed through stuffing boxes fixed on the outer wall of the kiln.

(2) Fixed in a quick lime-cooling chamber is a gas ejector to repeatedly circulate hot gas through a maturation zone defined in the upper section of said cooling chamber. The gas ejector comprises a gas-passing cylinder positioned in the maturation zone; an air inlet nozzle open to the bottom of said gas-passing cylinder and a gas dispersion baffle coronet disposed above the gas-passing cylinder.

DETAILED DESCRIPTION OF THE INVENTION

Figure 1:
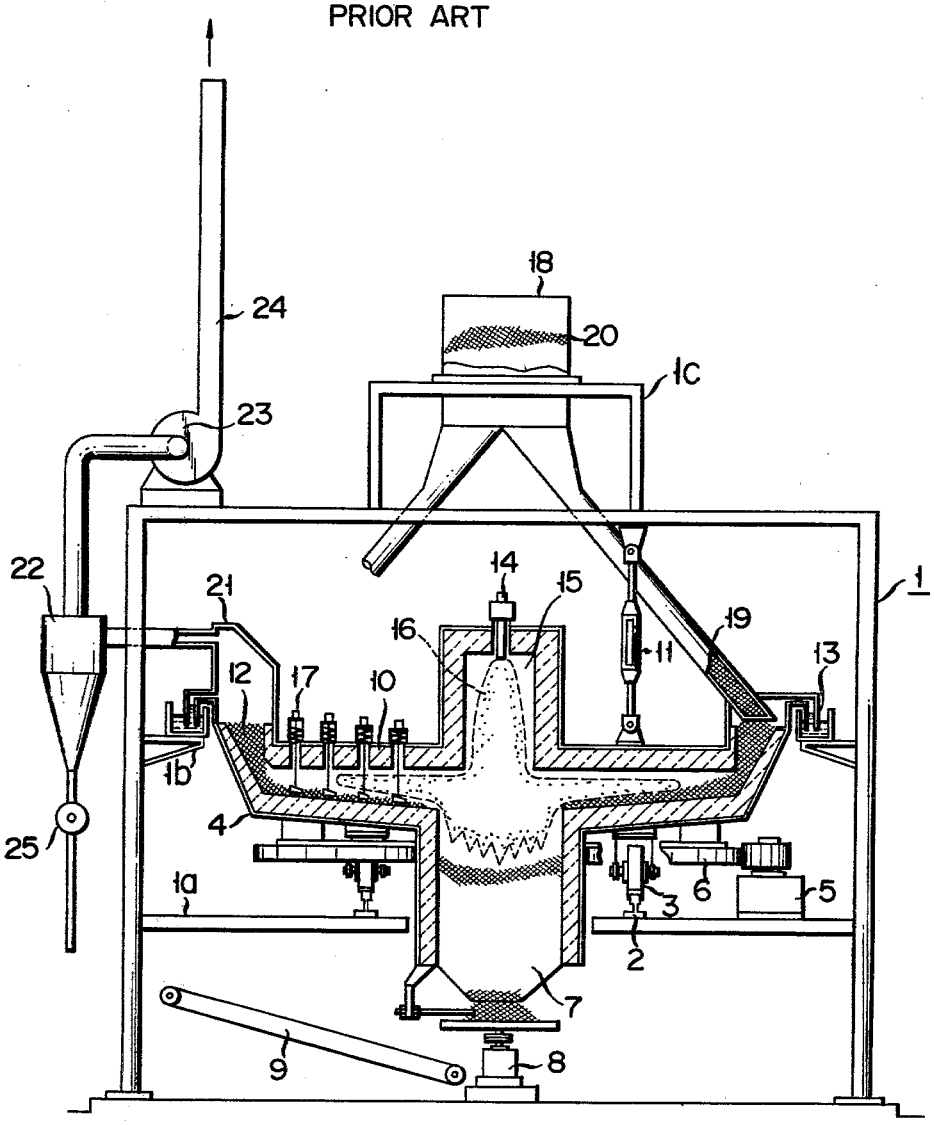
FIG. 1 PRIOR ART
FIG. 1 is a partial longitudinal sectional view of the top-shaped lime kiln embodying the preceeding invention.

We will now describe by reference to FIGS. 2 to 5 the construction, operation and effects of the present improved top-shaped lime kiln including the parts of a lime kiln embodying the preceding invention. Reference numerals 1 to 25 except for 17 denote parts common to both the present and preceding inventions.

Figure 2:
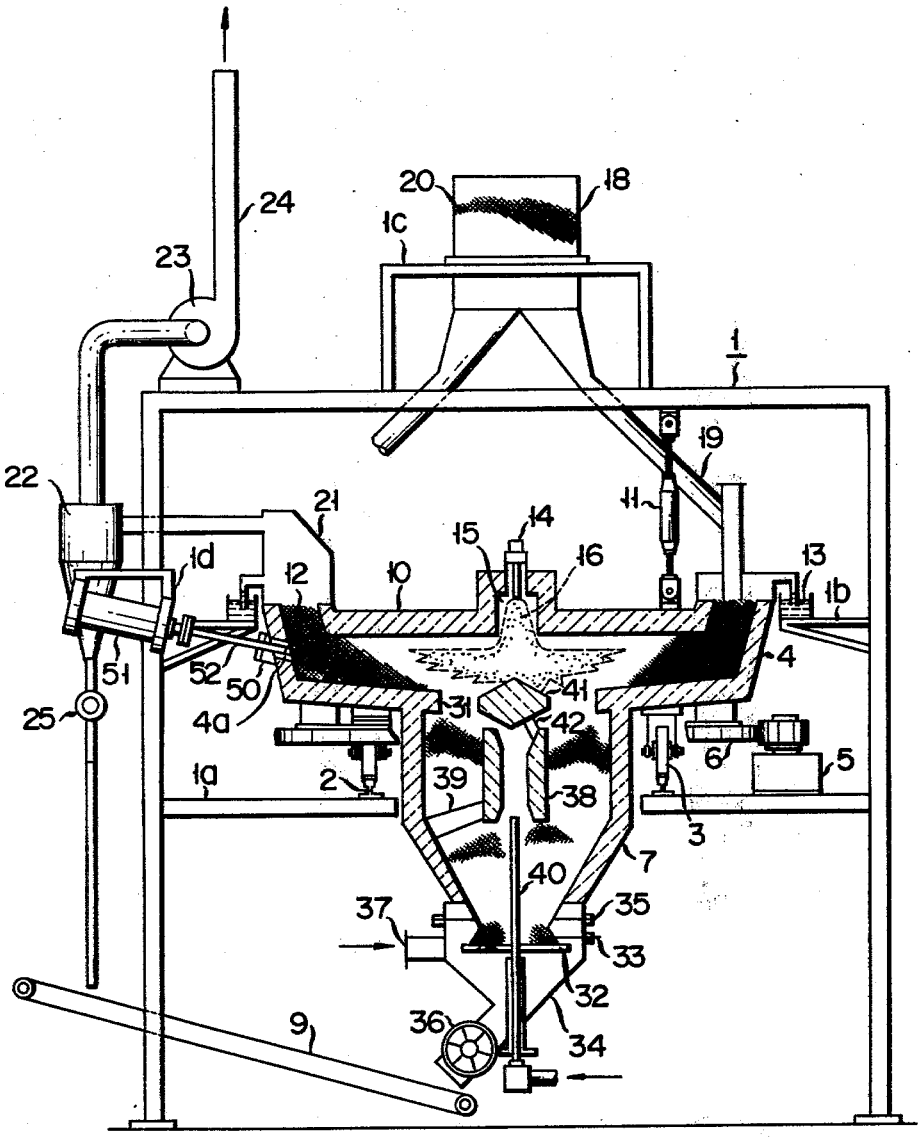
FIG. 2 is a partial longitudinal sectional view of a top-shaped lime kiln according to one embodiment of the present invention.
Figure 3:
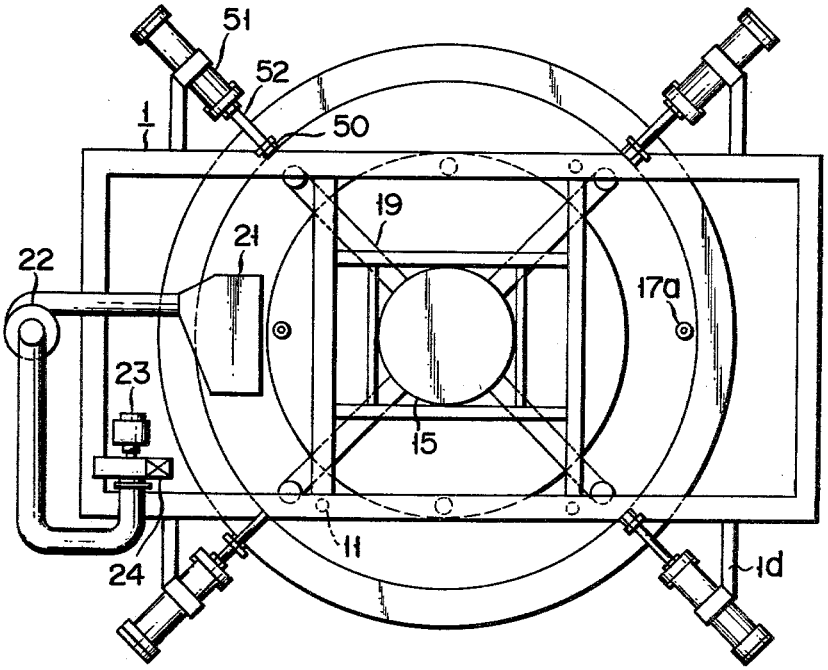
FIG. 3 is a plan view of the kiln of FIG. 2.

Referring to FIGS. 2 and 3, a circular rail 2 is laid on the lower stage 1*a* of a trestle 1 fixed on the ground. A platter-shaped kiln bed 4 provided with wheels 3 is slowly rotated about the vertical axis continuously or intermittenly by a gear 6 driven by a motor 5 with a speed of approximately 2 rotations per hour. Communicating with the bottom opening of the central portion of kiln bed 4 is an integrally formed cooling chamber 7 which is designed to mature and cool the calcined lime and to be jointly rotated with the kiln bed 4. In this case, it is preferred for the reason which will be given later to form an annular inwardly extending projection 31 around said central opening of the kiln bed 4, causing said opening to have a smaller diameter than the inner diameter of the cooling chamber 7.

The bottom portion of the cooling chamber 7 opens in a funnel-shaped form. Calcined quick lime, which continuously falls out of said funnel-shaped portion, temporarily rests on a receptacle plate 32. Thereafter, the product is allowed to fall from said receptacle plate 32 into a storage chamber 34 by scrapers 33. The quick lime storage chamber 34 is set independent of the rotation of the cooling chamber 7 by means of a mechanically revolving seal 35. The quick lime received in the storage chamber 34 is continuously drawn off by a rotary feeder 36 placed below said storage chamber 34 onto a belt conveyer 9, which carries the product to a suitable place. This quick lime discharge section does not constitute the important part of this invention, and said section may be simplified into the form indicated in FIG. 1.

The upper part of the quick lime storage chamber 34 is provided with an inlet port 37 to supply secondary air for perfect combustion of fuel. Air is drawn into the kiln through the secondary air inlet port 37 by reduced pressure generated in the kiln by the later described suction blower 23. Heat exchange takes place between the calined lime and the air passing through it. The heated air flows upward into the reaction chamber of the kiln to effect the complete combustion of imperfectly burning flames ejected into the reaction chamber by the later described burner 14. A product of quick lime has a temperature of 50° to 70° C. when discharged from the kiln.

A round lid 10 covering the platter-shaped rotary kiln bed 4 is immovably suspended horizontally and co-axially with said kiln bed 4 by the suspension hooks which are each provided with a turnbuckle 11. The central part of the lid 10 projects upward as described later. The distance between the lid 10 and the kiln bed 4 can be controlled by the turnbuckle 11. A considerably wide annular gap 12 is defined between the peripheral walls both lid 10 and kiln bed 4. This annular gap 12 is shut off from the open air by a gas leakage-preventing device 13 such as a water sealer, sand sealer or elastic sealer mounted on the intermediate stage 1*b* of the trestle 1. The kiln bed 4 is rotated without being obstructed by the lid 10 suspended from the trestle 1. A fuel combustion chamber 15 provided with a downwardly extending burner 14 is formed in the central upward projection of the lid 10 for communication with the kiln reaction chamber. Calcination temperature in the kiln reaction chamber generally stands at 1100° to 1500° C.

Raw limestone granules 20 held in a limestone storage tank 18 set on the upper stage 1*c* of the trestle 1 continuously run down through a proper number of (four indicated in FIG. 3) chutes 19 into the annular gap 12. The raw granules are carried onto the kiln bed 4, and, while being calcined, are allowed to fall into the cooling chamber 7 by the later described pushing rods 52. A mixture of combustion gas in the reaction chamber and carbon dioxide gas released due to thermal decomposition of limestone flows through a limestone granules layer filled in the annular gap 12. After preheating the limestone granules layer, the gas mixture is collected in a gas-collecting chamber 21 placed adjacent to the water sealer 13. The gas mixture cooled in said chamber passes through a dust collector 22 of cyclone type and is discharged into the open air by a suction blower 23 through a chimney 24. An exhaust just released from the kiln generally has a temperature of 200° to 300° C. A reference numeral 25 denotes a rotary valve attached to the dust collector 22 for taking out of collected dust.

A gas ejector is fixed in the calcined lime-cooling chamber 7 to circulate a hot gas through the maturation zone of the calcined lime granules layer. A gas-passing cylinder 38 made of heat-resistant material is fixed to the upper central portion of the cooling chamber 7 by a plurality of supporting rods 39. The upper end of an air ejection nozzle tube 40 inserted into the cooling chamber 7 from below along the axis thereof opens to the lower end of said gas-passing cylinder 38. A baffle coronet 41 is securely set by a plurality of supporting rods 42 a little above the gas-passing cylinder 38 to disperse gases flowing out of the upper opening of said cylinder 38 to the surrounding regions. Thus, air ejected from the nozzle tube 40 causes hot gas to flow downward through a mass of calcined lime granules falling along the outer wall of the cylinder 38, eventually giving rise to the circulation of hot air, and consequently effecting the maturation of the calcined lime. Gas running downward through the maturation zone generally has a temperature of 900° to 1300° C.

As previously described, it is preferred that an annular inward-extending projection 31 be formed around the opening of the platter-shaped rotary kiln bed 4 which communicates with the opening of the calcined lime-cooling chamber 7. The reason for this is as follows. The calcined lime granules falling off the annular projection 31 are turned upside down in a space defined below said projection 31 to have their heat-receiving surfaces changed. At this time, a mass of calcined lime granules occupying the maturation zone forms a ridge as shown in FIG. 2, thereby suppressing the drift or deflected flow of gases in the maturation zone, and consequently preventing the imperfect calcination of lime granules.

Heat-resistance rods (not shown) are inserted, if necessary, through holes drilled in the lid 10 to detect the level of the mass of calined lime granules occupying the upper section of the maturation zone, thereby always maintaining said mass at a proper level.

The inner bottom plane of the rotary kiln bed 4 is slightly inclined toward the center in the form of a funnel, thereby facilitating the smooth run of limestone granules toward said center with the aid of scrapers 17. However, it has been disclosed that the scrapers 17 fitted to the lid 10 as illustrated in FIG. 1 can not effect sufficiently the free fall of calcined lime granules into the cooling chamber 7. With the top-shaped lime kiln of the present invention, therefore, reciprocative pushing rods 52 of a plurality of pushers 51 are repeatedly thrust forth into the limestone granules layer spread on the rotatable kiln bed 4 through holes **4*a* drilled in the peripheral wall of the platter-shaped kiln bed 4 (FIG. 2) or the lid 10 (FIG. 5), thereby effectively causing the lime granules to fall into the cooling chamber 7**.

We will now describe by reference to FIGS. 2 and 3 the construction and operation of the pushing assembly. According to the present invention, a plurality of pushers 51 through each of which a pushing rod 52 reciprocates by compressed oil or air are securely fixed to a plurality of (for example, four, as shown in FIG. 3) trestles **1*d* set apart from the kiln body. The pushing rods 52 are forcefully inserted toward the kiln center through the stuffing or sealing boxes 50 so placed as to surround the holes 4*a* drilled in the peripheral wall of the kiln bed 4 to let a limestone granules layer spread on the kiln bed 4 fall into the cooling chamber 7. The hole 4*a* has a larger diameter than that of the pushing rod 52, enabling the pushing rod 52 to make one reciprocation without difficulty while the kiln bed 4 is slowly rotated with a speed of about 2 rotations per hour (r.p.h.). Where, however, the kiln bed 4 is rotated at a higher speed, then the motor 5 is intermittently driven by an automatic means, thereby rotating the kiln body intermittently at a small rate each time. As a result, the pushing rod 52 is inserted into the hole 4*a*** while the kiln bed stands at rest. Assuming that the kiln bed is intermittently rotated through an angle of, for example, 10° each time, then the kiln bed makes 36 intermittent runs while being fully rotated once, thereby causing each of the pushing rods to be inserted 36 times into the kiln body during its one full rotation.

The quantity of calcined lime produced per unit time can be easily controlled by adjusting the extent to which the pushing rod 52 is inserted into the kiln body and the per unit time frequency in which said insertion is repeated. The pushing rod which is retained in the kiln body for an extremely short time is saved from deformation or damage resulting from high kiln temperature.

Figure 4:
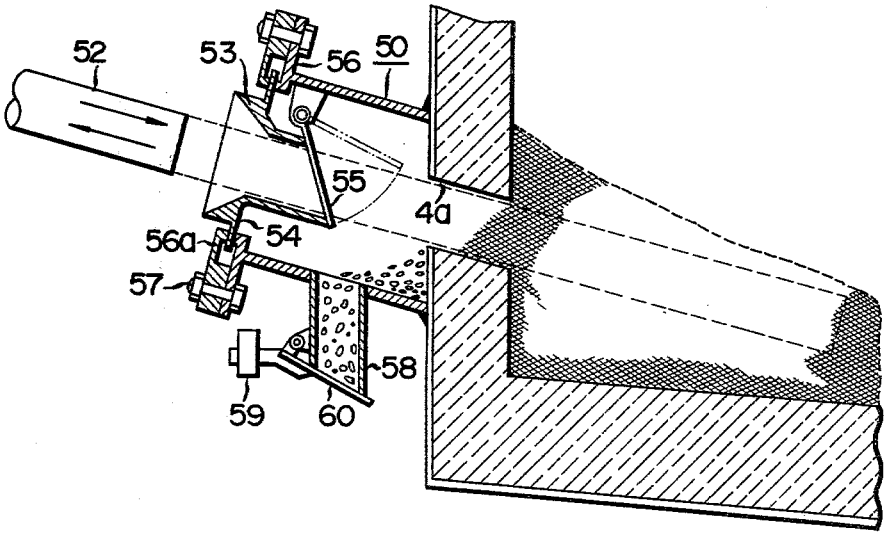
FIG. 4 is an enlarged longitudinal sectional view of that portion of the lime kiln of FIG. 2 to which the stuffing box is fitted.

We will now describe by reference to FIG. 4 the construction and operation of the cylindrical stuffing or sealing box 50 surrounding the pushing rod hole **4*a*. The stuffing box 50 is provided at the outer end portion with a fixed flange 56 and a corresponding free flange 56*a*, each set being combined with a bolt-nut assembly 57. The axis of the stuffing box 50 extends toward the kiln body center. A flange 54 fitted to a pushing rod-receiving funnel 53 is slidably supported between the fixed flange 56 and the corresponding free flange 56*a*. Even where, therefore, the kiln bed 4 is slightly subject to thermal deformation, said slidable flange 54 enables the axis of the pushing rod 52 to be well aligned with the center of the hole 4*a*. The inner end of the pushing rod-receiving funnel 53 is closed by the revolving gravitation of a valve seal 55, which is rotatably suspended from the upper end portion of cylindrical stuffing box 50. When the pushing 52 is inserted into the funnel 53, the forward end of the rod opens the valve seal 53 and moves into the stuffing box 50, and then into the kiln bed, thereby pushing the lime granules layer more inward. When the pushing rod 52 is pulled out of the kiln body, then the valve seal 55 automatically closes the inner end of the funnel 53, thereby maintaining the gas tight condition of the stuffing box 50**.

When the pushing rod 52 is drawn out of the stuffing box 50, a small amount of limestone granules leaks out of the hole **4*a* and accumulates in the stuffing box 50. For automatic discharge of said collected limestone granules, the underside of the stuffing box 50 is provided with a small storage chamber 58 for holding leaked limestone granules. The lower end of the storage chamber 58 is closed by a rotatably mounted bottom lid 60 fixed to a weight 59. When a prescribed amount of leaked limestone granules accumulates in the storage chamber 58, the bottom lid 60 is automatically opened to discharge said limestone granules. Thereafter, the lid 50 automatically closes the storage chamber 58 by means of the weight 59**.

Figure 5:
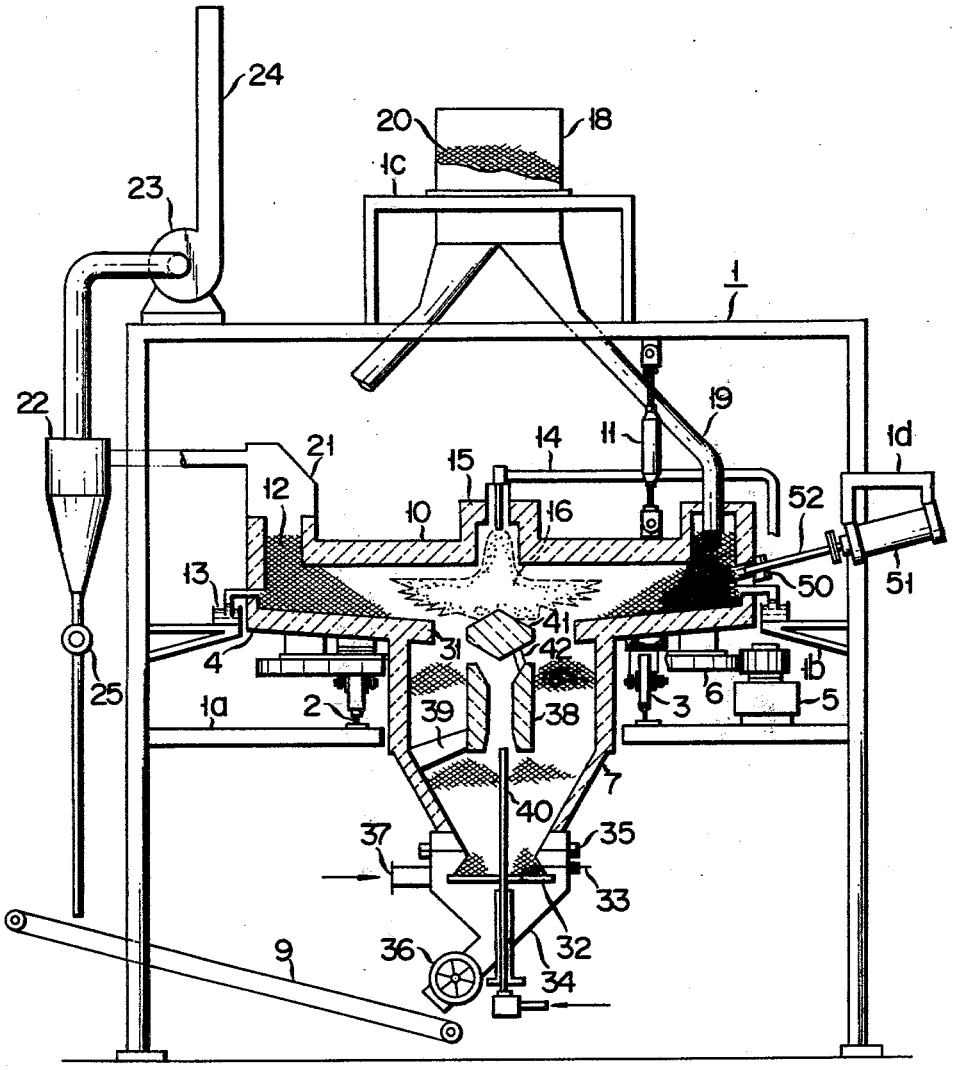
FIG. 5 is a partial longitudinal sectional view of a top-shaped lime kiln according to another embodiment of the present invention.

We will now describe by reference to FIG. 5 a lime kiln according to another embodiment of the present invention. An assembly of the stuffing or sealing box 50, pushing rod 52 and pusher 51 is provided on the peripheral wall of the kiln lid 10. In this case, the kiln lid 10 is nonrotatably fixed on the trestle 1, making it unnecessary to provide so many pushing rod holes **4*a* as used in FIG. 2. The holes 4*a* have only to be formed at points corresponding to the pushing rods 52 used. The limestone granules spread on the kiln bed 4 are shifted with the rotation of the kiln bed, and the calcined lime granules are successively allowed to fall into the cooling chamber 7 by the reciprocation of the pushing rods 52** from a prescribed position.

With the lime kiln of FIG. 5, the entire length of the pushing rod 52 need not be drawn out of the kiln body 4. Namely, as seen from FIG. 5, the forward end portion of the pushing rod 52 can be held in the hole 4*a* drilled in the peripheral wall of the lid 10. In this case, the interior of the kiln body is substantially isolated from the open air by the forward end portion of the pushing rod 52, making it unnecessary to provide the stuffing box 50 with the valve seal 55 of FIG. 4.

We will now describe an example where a lime kiln embodying this invention was actually put into operation. The kiln used has a maximum diameter of about 6 meters on the basis of producing 30 tons of quick lime per day. The kiln bed was rotated approximately twice per hour. Heat consumption indicated 950,000 kcal per 1000 kg of quick lime. Carbon dioxide remaining in the quick lime produced accounted for 1.5% by weight or less. Pressure prevailing in the kiln body stood at −100 mm Aq. The amount of exhaust was 1900 $Nm^3$ per ton of quick lime. The exhaust had a composition of 29% of $CO_2$, 8% of $H_2O$, 59% of $N_2$ and 4% of $O_2$, all measured by volume.

What we claim is:

1. In a top-shaped lime kiln comprising a rotatable platter-shaped kiln bed (4) having a central opening; a cylindrical calcined lime cooling chamber (7) extending downwardly from said central opening of said kiln bed (4); a stationary coaxial round lid (10) over said bed and having a central opening; a fuel combustion chamber (15) extending upwardly from said central opening of said lid (10); said bed (4) and lid (10) having peripheral walls, an annular gap (12) being defined between said peripheral walls of said bed and lid; raw limestone granules feeding chutes (19) opening and feeding into said annular gap (12) defined between said peripheral walls of said bed and lid; and an effluent gas collecting chamber (21) which covers said annular gap (12) and which is connected to an annular gas leakage preventing device (13);

the improvement wherein:

a hot gas recirculating device is coupled in the upper section of said cylindrical calcined lime cooling chamber (7), said hot gas recirculating device comprising a substantially vertically arranged gas-passing cylinder (38) mounted in said cooling chamber (7); an air ejecting nozzle tube (40) extending into said cooling chamber (7) from below said chamber (7) and cylinder (38) and opened to the lower end of said gas-passing cylinder (38); and a gas baffle coronet (41) disposed above said gas-passing cylinder (38);

at least one of said kiln bed (4) and lid (10) has a plurality of holes formed in the peripheral wall thereof;

a plurality of sealing boxes (50) are affixed to said wall surrounding said holes; and a plurality of automatically reciprocating pushing rods (52) are provided for insertion into a limestone granules layer spread on the kiln bed (4) through said sealing boxes (50) and through said plurality of holes formed in the peripheral wall of at least one of said kiln bed (4) and lid (10) to push calcined lime from said kiln bed (4) into said cylindrical calcined lime cooling chamber (7).

2. The top-shaped lime kiln according to claim 1, comprising an annular inwardly extending projection (31) formed around said central opening of said rotary kiln bed (4) and which communicates with the upper opening of said cylindrical calcined limie cooling chamber (7).

3. The top-shaped lime kiln according to claim 1 or 2, wherein each of said sealing boxes (50) comprises an elongated open member mounted at one end to said peripheral wall in registration with one of said openings, said elongated member having an open end with flanges (56,56*a*); a pushing rod receiving funnel (53) having a flange (54) at the inlet portion thereof; said flange (54) of said funnel (53) being slidably supported between said flanges (56,56*a*) of said elongated member by a bolt-nut assembly 57; and a selectively openable valve seal 55 hanging from the top portion of said sealing box (50).

4. The top-shaped lime kiln according to claim 3 wherein said elongated member is a cylindrical member.

5. The top-shaped lime kiln according to claim 3, wherein said sealing boxes further comprise a leaking raw material storage chamber (58) fixed to the underside thereof, said storage chamber (58) having a bottom lid (60) rotatably supported by a rotary weight (59).

6. The top-shaped lime kiln according to claim 1, wherein said platter-shaped kiln bed (4) is rotated by a rotating means at a speed of approximately 2 r.p.h.

7. The top-shaped lime kiln according to claim 1 or 6 wherein said openings are formed in said peripheral wall of said kiln bed (4).

8. The top-shaped lime kiln according to claim 1 or 6 wherein said openings are formed in said peripheral wall of said coaxial round lid (10).

9. The top-shaped lime kiln according to claim 1 wherein said cooling chamber (7) is connected to and rotatable with said kiln bed (4).

* * * * *